US007007508B1

(12) United States Patent
Valentini

(10) Patent No.: US 7,007,508 B1
(45) Date of Patent: Mar. 7, 2006

(54) TWISTED NECKLACE/BRACELET

(75) Inventor: Paola Valentini, Paris (FR)

(73) Assignee: Gold Brands Holdings, Inc., New York, NY (US)

( * ) Notice: Subject to any disclaimer, the term of this patent is extended or adjusted under 35 U.S.C. 154(b) by 0 days.

(21) Appl. No.: 10/823,106

(22) Filed: Apr. 12, 2004

(51) Int. Cl.
*A44C 5/00* (2006.01)

(52) U.S. Cl. ..... 63/3.1; 63/3; 63/3.1; 63/38

(58) Field of Classification Search ..... 63/3–7, 63/9, 10, 15, 15.1, 15.45, 15.5, 26, 33, 37–39; 59/3, 35.1, 78, 80, 82, 93, 95
See application file for complete search history.

(56) References Cited

U.S. PATENT DOCUMENTS

| | | | | |
|---|---|---|---|---|
| 1,403,600 | A * | 1/1922 | Grand | 63/11 |
| 1,894,195 | A | 1/1933 | Pulver | 63/28 |
| 2,258,413 | A * | 10/1941 | Koven | 63/31 |
| 3,192,738 | A | 7/1965 | Charles et al. | 63/39 |
| 3,323,325 | A | 6/1967 | Meyer | 63/4 |
| 4,014,079 | A | 3/1977 | Camarda | 24/684 |
| 5,343,718 | A | 9/1994 | Pöll | 63/26 |
| 5,592,835 | A | 1/1997 | Herr | 63/4 |
| 5,682,736 | A * | 11/1997 | Chia et al. | 59/35.1 |
| 6,220,010 | B1 * | 4/2001 | Gomez | 59/80 |
| 6,629,434 | B1 | 10/2003 | Chia et al. | 63/26 |
| D481,968 | S | 11/2003 | Cerato | D11/12 |
| 2003/0089128 | A1 * | 5/2003 | Minassian | 63/4 |
| 2003/0106337 | A1 | 6/2003 | Rosenwasser et al. | 63/4 |
| 2003/0111005 | A1 * | 6/2003 | Lord et al. | 116/307 |

* cited by examiner

*Primary Examiner*—William L. Miller
*Assistant Examiner*—Ruth C. Rodriguez
(74) *Attorney, Agent, or Firm*—Levisohn, Berger & Langsam, LLP

(57) ABSTRACT

A twisted tennis bracelet or necklace is provided comprising individual elements which have male and female components, the male and female components being angularly offset with respect to each other along a longitudinal axis therethrough such that a jewelry article formed of such elements has a twist or spiral look. The outer edges, tops, and/or bottoms of the individual elements are capable of receiving a jewel stone or other ornamental feature.

64 Claims, 11 Drawing Sheets

TWISTED NECKLACE/BRACELET

BACKGROUND OF THE INVENTION

1. Field of the Invention

This invention relates to an apparatus and structure for a bracelet or necklace which when assembled has a spiral visual effect and may be referred to as a twisted tennis bracelet.

2. Description of the Related Art

Tennis bracelets are extremely popular throughout the world. Their look is attractive because of the glittering effect of the stones carried on the bracelet when worn. All of the stones project from the same plane, and tennis bracelets have been a part of the jewelry industry for many years.

SUMMARY OF THE INVENTION

An object of the present invention is to provide an improved and attractive bracelet which resembles the general feeling of a tennis bracelet but is materially enhanced.

Another object of this invention is to provide an improved structure made from modules which are easy to assemble and provide great variability in the assembly process to provide a variety of visual looks.

Yet another object of this invention is to provide a twisted tennis bracelet which will provide an overall appearance having significantly greater value than the actual value of the parts used to form the twisted tennis bracelet.

Still another object of this invention is to provide a twisted tennis bracelet which will be extremely attractive, economical, and likely to find great success in the industry.

Other objects, advantages, and features of this invention will become more apparent from the following description of the invention, which is a twisted jewelry article such as a bracelet or necklace.

The inventive article is made up of a plurality of modules, each module including a main body having a longitudinal axis, a female receptacle disposed inside the main body and accessible via a rear portion of the main body, and a male tab projecting from a front portion of the main body. The male tab of one module is fittable within an adjacent female receptacle of an adjacent module. At least one surface of the male tab is substantially contactable at least one surface of the adjacent female receptacle. In a certain sub-plurality or all of the modules, at least one outer surface of the male tab is angularly offset with respect to an inner surface of the female receptacle of the same module about the longitudinal axis to thereby angularly offset adjacent of the modules having the offset, to thereby impart a longitudinal twist to the jewelry article.

In the preferred embodiment, the angular offset between adjacent modules is uniform along the length of the jewelry item. Preferably, the angular offset between the first and second surfaces is between 9 and 18 degrees. The offset may be more or less depending upon design considerations. In one embodiment, the width of the tab is substantially identical to the width of the receptacle, to thereby substantially eliminate angular play between adjacent modules. In another embodiment, the width of the tab is slightly smaller than the width of the receptacle, to thereby substantially allow angular play between adjacent of the modules and thus allow the wearer to adjust but not eliminate the longitudinal twist imparted to the jewelry article. In this embodiment, the angular play allowed between adjacent modules is less than the angular offset. Thus, in the embodiment where angular play is prevented, one could consider the twist to be fixed.

But as described above wit the other embodiment in which angular play is allowed, the amount of twist can be varied by the wearer between upper and lower limits to effect visual changes in the amount of twist in the article.

The inventive jewelry article preferably also includes at least one ornamental surface disposed on at least a portion of the modules in the same corresponding position for each module; the longitudinal twist makes the ornamental surfaces of the modules take the form of a spiral about the longitudinal axis of the article. The ornamental surface may be a mounting space along a side of the main body upon which jewelry stones are mountable, or a jewelry stone may be mounted directly to a first side of at least a portion of the plurality of modules. The jewelry stones employed in the invention may include diamonds, rubies, sapphires, emeralds, non-precious stones, and/or combinations thereof. In one embodiment, one set of jewelry stones of a first type are mounted on one side of the modules and another set of jewelry stones of a second type are mounted on another side (preferably the opposite side) of the modules. Since both sets of stones spiral around the longitudinal axis of the jewelry article, the effect is quite attractive.

Similarly, in one embodiment, at least selected ones of the plurality of modules comprise precious metal, such as gold, silver, and/or platinum, and/or combinations thereof. The precious metal may be the same for all of the select modules, or it may be different.

The main body of each module may be rectangular, square, cylindrical, or polyhedral in shape. In a preferred embodiment, the main body is made of two substantially parallel plates attached to opposite sides of the female receptacle, the plates having spaces therebetween at opposite ends. First jewelry stones may be mounted in one of these end spaces in at least a number of (or all of) the modules, and second jewelry stones, different from the first jewelry stones, may be mounted in a second of the spaces opposite the first space in at least the number of (or all of) the modules.

In accordance with the principles of this invention, a spiral twisted article of jewelry, such as a bracelet or necklace, is formed of individual link modules which, when assembled, provide a twisted tennis bracelet or necklace that, preferably, can carry jewelry stones along one or both the outer edges of the bracelet. Additionally, jewelry stones may be mounted on the top and/or bottom of the bracelet, and the twisted bracelet effect will materially enhance the overall glitter and attractiveness of this new jewelry item.

Because of the unique twisted structure of the present invention, a variety of looks and motifs may be achieved with the manufacturer being able to use diamonds alone, diamonds and other precious stones, non-precious stones, gold, silver, or any other metal. These parts are assembled with the module of the present invention to provide a twisted, attractive, glittering effect for the structure, whether worn as a bracelet or necklace.

While the present invention may be most attractively utilized as a tennis bracelet, it may also find wide acceptance and success when assembled and worn as a necklace. The twisted assembly which displays precious stones along one or both of the opposite outer edges of the assembled links is neither found, suggested, nor disclosed anywhere in the prior art and represents a significant improvement in the jewelry industry.

DETAILED DESCRIPTION OF THE PREFERRED EMBODIMENTS AND DRAWINGS

This invention provides a unique, novel and unusual jewelry item in the form of a bracelet or necklace having a spiral look which, conveniently, can be called a twisted tennis bracelet.

As will be described in detail below, each module has of male and female elements, and the spiral look is achieved due to the male part being tilted or rotated with respect to the female part along the longitudinal axis through the male and female elements. Thus, there is a central axis running through the longitudinal center of the jewelry item, and the degree of twist about such nominal longitudinal axis defines the number of modules required to achieve 180 degree rotation or any other desired rotation.

The invention will now be described with reference to the appended drawings, FIGS. 1–11. It should be noted that these drawings are exemplary in nature and in no way serve to limit the scope of the invention which is defined by the claims appearing hereinbelow.

Figure 1:
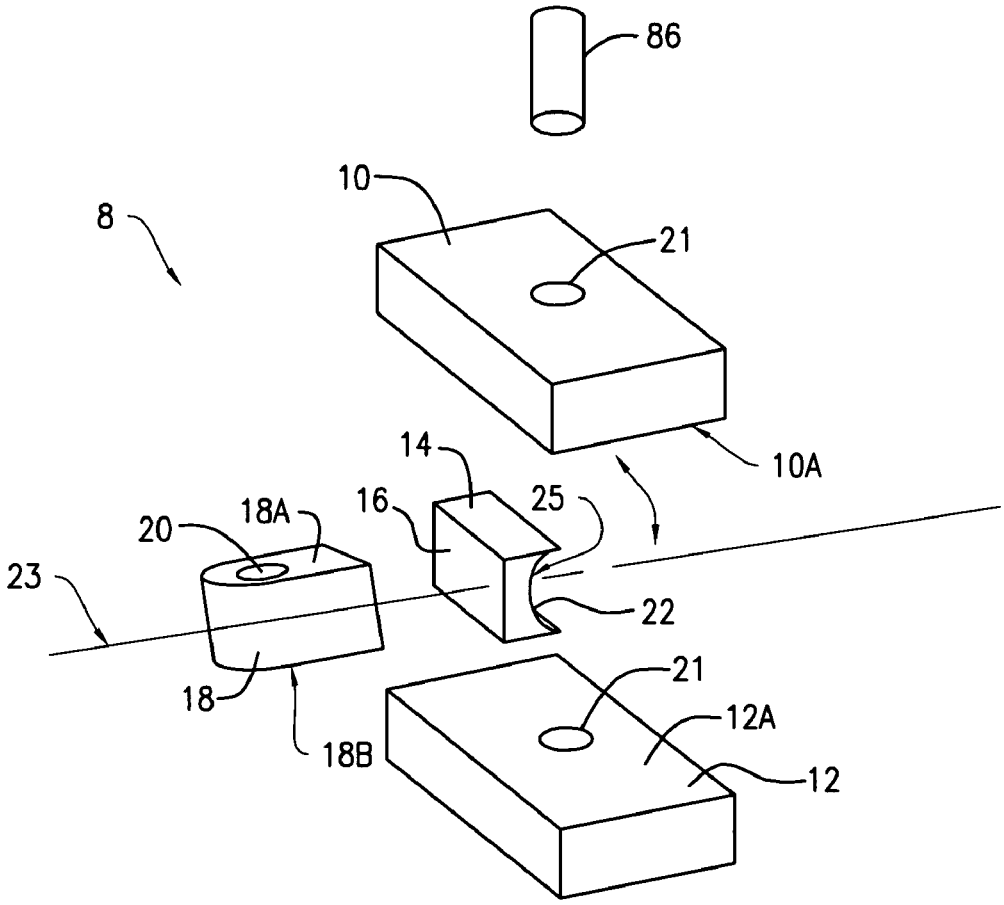
FIG. 1 is an exploded perspective view of the elements which make up a module of the present invention.

FIG. 1 is an exploded perspective and FIG. 2 is a perspective view of the individual module 8. The entirety of the module can be molded as a single unitary assembly or may be made in any other form as desired. The module 8 depicted in FIGS. 1 and 2 comprises upper and lower rectangular plates 10 and 12 similarly dimensioned attached on the top and bottom of a small spacer 14 which is joined at its front face 16 to a male connector tab 18, the male connector tab 18 having a rounded front surface with an aperture 20 located through the tab 18. Apertures 21 are located substantially in the center of upper and lower plates 10 and 12. The rounded front surface of male tab 18 sits within rounded inner wall 22 formed at the rounded rear surface of spacer 14. Inner wall 22, underside surface 10A of plate 10, and upper surface 12A of plate 12 all together form female receptacle 25 which houses and contains tab 18.

Figure 2A:
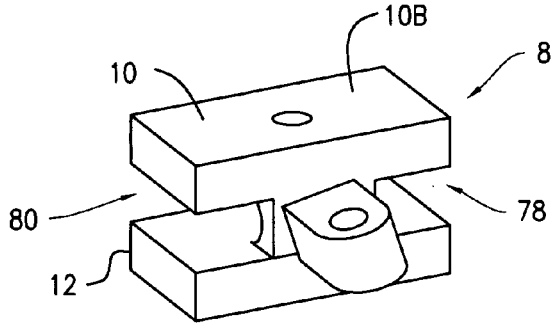
FIG. 2A is a front left perspective view of the separate elements of FIG. 1 shown together forming a module.
Figure 2B:
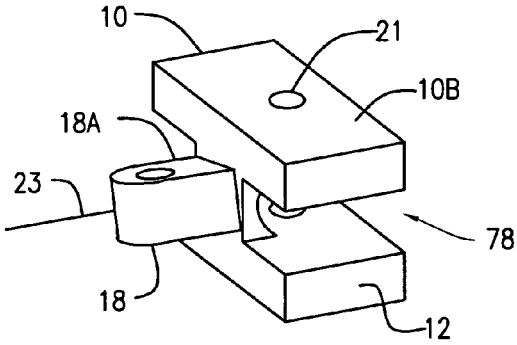
FIG. 2B is a right front perspective view of the module of FIG. 2A.
Figure 2C:
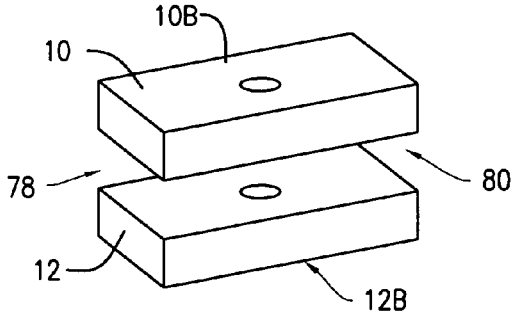
FIG. 2C is a rear perspective view of the module of FIG. 2A.
Figure 2D:
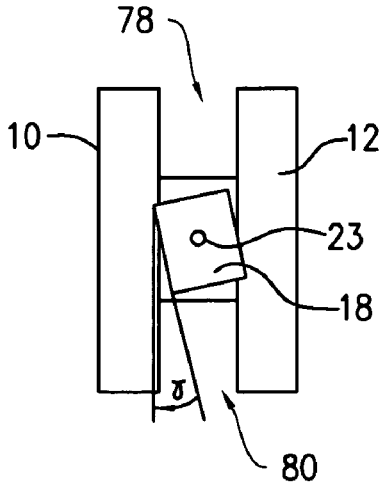
FIG. 2D is a front elevational view of the module of FIG. 2A.
Figure 2E:
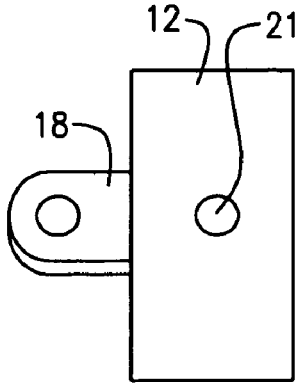
FIG. 2E is a top elevational view of the module of FIG. 2A.
Figure 2F:
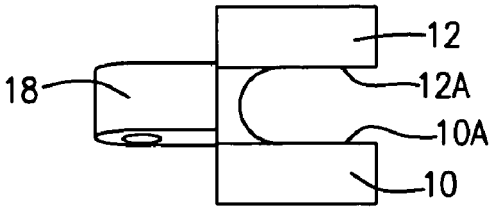
FIG. 2F is a side elevational view of the module of FIG. 2A.
Figure 2G:
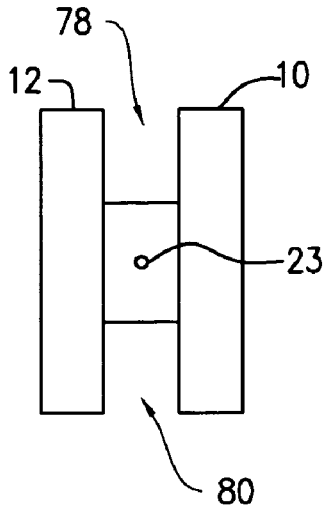
FIG. 2G is a rear elevational view of the module of FIG. 2A.

As best shown in FIGS. 2A, 2B, and 2D, there is a cant or angular offset along the longitudinal axis 23 between tab 18 and upper surface 15 of spacer 16. More specifically, since spacer 16 is substantially rectangular and since plates 10 and 12 are substantially parallel, module 8 is formed with an angle $\alpha$ between tab upper surface 18A and plate lower surface 10A (and preferably the same angle $\alpha$ between tab lower surface 18B and plate upper surface 12A). As will be described below, the amount of such angular offset can be the same for each module or modules could be formed with variations in the angular offset. Alternatively, some modules may be provided with an angular offset, and some may not. Because of this angular offset $\alpha$, one module 8 must be rotated about its longitudinal axis 23 by a degrees to cause its tab 18 to align properly with an adjacent module's receptacle 25. As such, since each module (or some modules) must be rotated with respect to its neighbor, a twist is imparted overall to the jewelry article as the modules are assembled one into the other.

As stated, the offset can be formed if the modules are made as integral units, or by attaching the male connector 18 to the spacer 14 at the desired angle. If the rotational offset is uniform throughout there will be a smooth spiral (as in FIG. 7), and if there is non-uniformity in the offset among the modules 8, there will be a more distinctive general spiral appearance. The single unit module 8 shown in FIG. 2 is the basic building block of the jewelry item of this invention. When male tab 18 is seated in female receptacle 25 apertures 20 and 21 align. A pin 86 is then soldered or otherwise secured in place attaching adjacent modules together. The round leading edge of tab 18 engages curved inner surface 22 in a way that enables tab 18 to rotate about pin 86 to thereby allow play in that angular direction, i.e., about an axis perpendicular to longitudinal axis 23.

However, depending upon the relative widths of tab 18 and receptacle 25 (that is, the space between surfaces 10A and 12A), the angular offset between adjacent modules 8 may be adjustable by twisting the jewelry article, example. Specifically, if the width of tab 18 is basically about the same as the width of receptacle 25, then upper surface 18A will securely contact surface 10A, lower surface 18B will securely contact surface 12A, and there will be no angular play between adjacent modules 8. If, on the other hand, the width of tab 18 is dimensioned to be smaller than the width of receptacle 25 (and by smaller it is meant to a greater degree than tolerances would require to allow tab 18 to be inserted into receptacle 25), then tab 18 can jiggle around within receptacle 25. The amount of jiggle or play that may be allowed may also depend upon the relative sizes of pin 86 and aperture 20. It is preferred that the amount of angular play allowed by the wearer will not be greater than angular offset α. If the jewelry article is twisted along its longitudinal axis in the same direction as offset α, the article will appear more twisted. Similarly, if the article is twisted in the opposite direction as offset α, the article will appear less twisted, but preferably not completely untwisted. This structure allows the wearer to select how twisted to make the appearance of the article simply by rotating one end of the article with respect to the other before closing the clasp.

Figure 7:
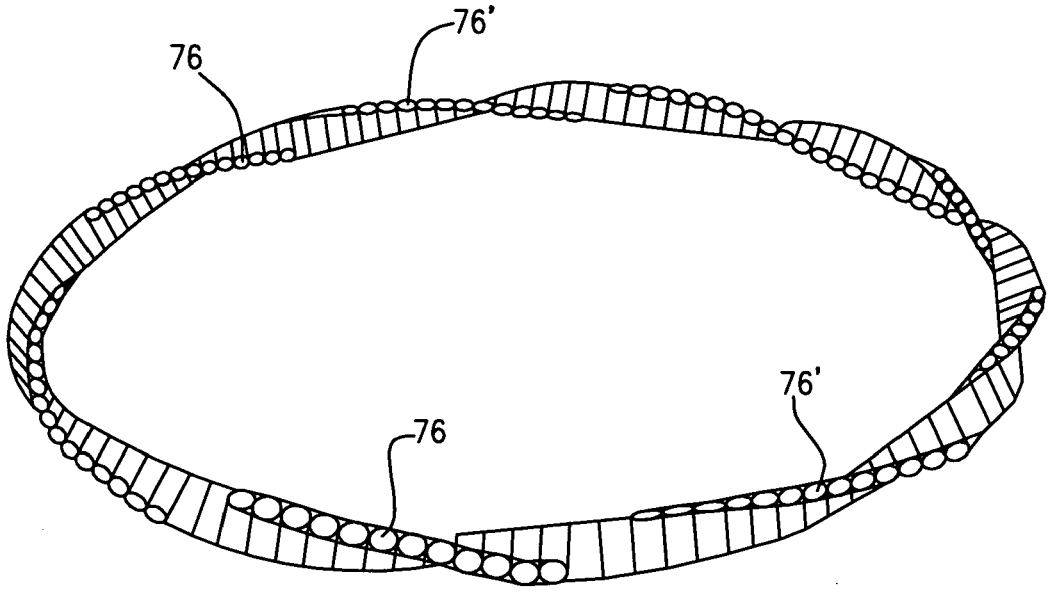
FIG. 7 is a schematic perspective view of the jewelry item of this invention showing stones mounted on opposite outer edges of the modules.

Each module 8 has a number of possible ornamental surfaces. For example, at opposite sides of module 8 as shown in FIGS. 1 and 2 are end spaces or gaps 78 and 80. These are the preferred ornamental surfaces for holing precious stones or jewels to be described below. A jewel stone may be disposed in one or both of gaps 78 and 80, either directly attached thereto, or in a conventional mounting device (not shown) such as a setting, bezel, or the like secured in the gaps. In one embodiment, one set of jewels is mounted in each gap 78 of each module 8, and another set of jewels is mounted in gap 80 of each module 8. Each set of jewels may include similar or different stones; the overall effect is that of both sets of jewels interspiralling around each other, as shown in FIG. 7.

Each module may, in addition or in the alternative, include jewel stones mounted on the upper and/or lower surfaces of plates 10 and 12 as will be described below.

Figure 3:
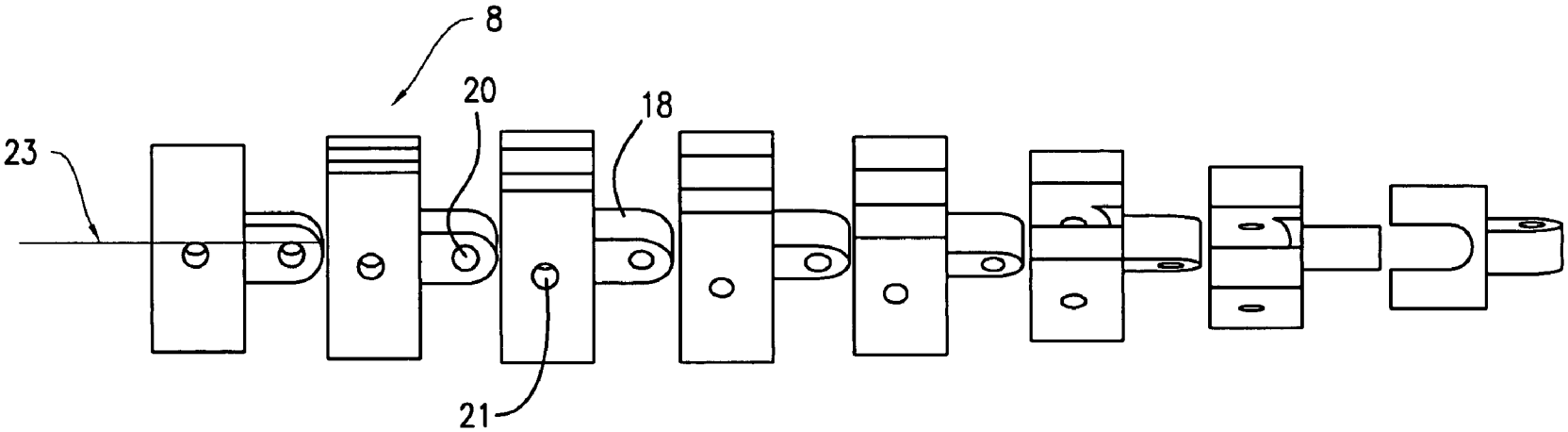
FIG. 3 is an exploded perspective view of a plurality of modules aligned one end to the other to form a spiral jewelry item.

FIG. 3 shows a plurality of modules 8 in an exploded perspective view with the modules about to be assembled one nested within the other. The relative rotation or twist achieved between male connecting tab 18 and spacer 14 determines the number of individual modules required to achieve a complete turn in the twist of the jewelry item. For instance, a 9° tilt or offset requires twenty modules 8 to achieve a 180° turn, and forty modules for a full 360° turn. An 18° offset requires ten modules for a 180° turn. If module 8 is 3 millimeters long, 20 modules will provide a jewelry item 60 millimeters long and 40 modules will provide a jewelry item of 120 millimeters. Obviously, the sizing of each module as well as the rotational specifications are design choices that can be made by the artisan.

Figure 4:
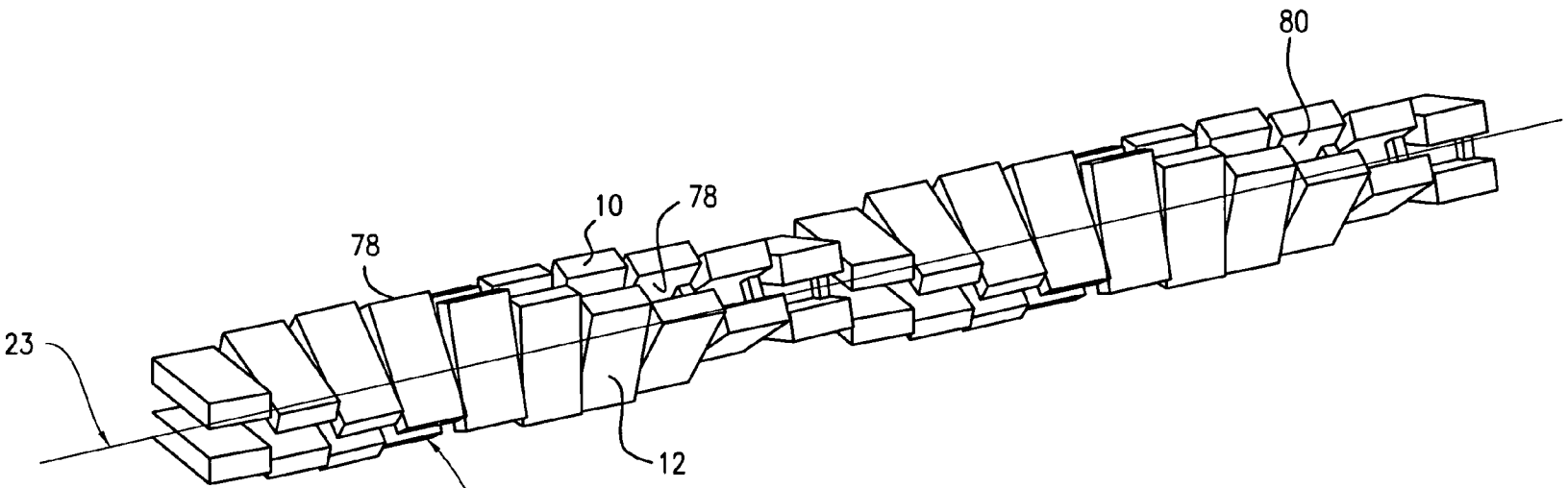
FIG. 4 is a perspective view showing a rendering of a twisted bracelet assembled in accordance with this invention, with mounting space for stones to be set along the outer edges.

FIG. 4 is schematic perspective rendition of the assembled jewelry item of FIG. 4. Plates 10 and 12 are separated by sufficient space to hold a precious stone mounted therebetween in the outer side gaps 78 and 80 as shown in FIG. 7. While FIG. 4 shows a regularity or uniformity between respective modules, the jewelry item of this invention may be assembled with each module having a different angular offset α with respect to a prior module so that a more irregular spiral look will be achieved.

Figure 5:
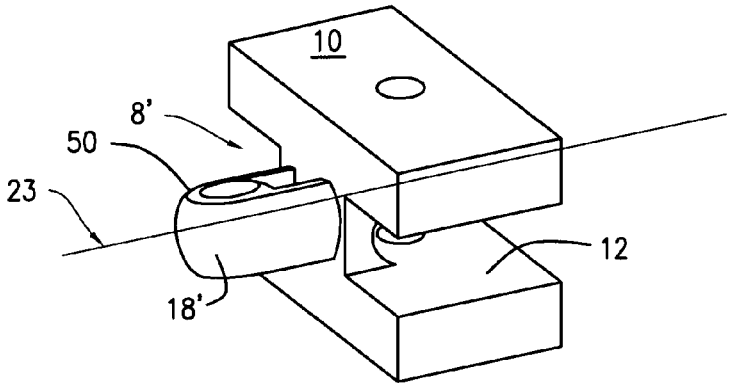
FIG. 5 is a perspective view of an alternative embodiment of the elements of the module of this invention.
Figure 6:
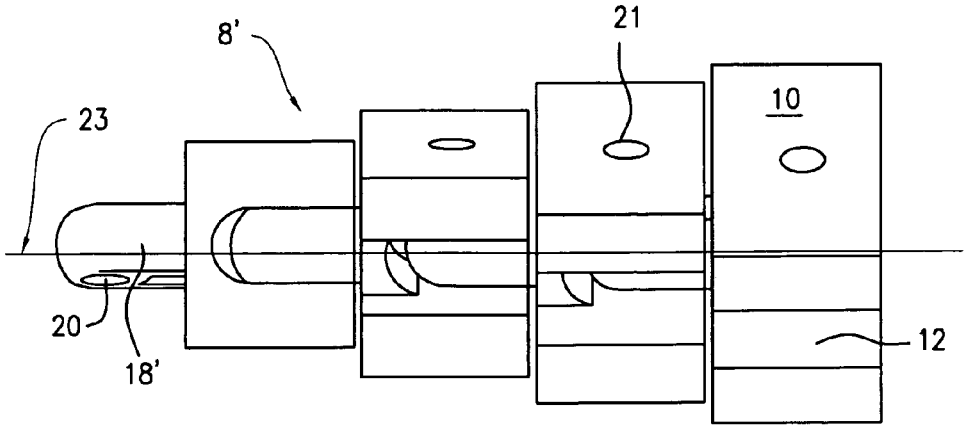
FIG. 6 is an exploded perspective view of the module elements of FIG. 5 being assembled to form a twisted jewelry item.

FIGS. 5 and 6 illustrate yet another embodiment of this invention in which the male connector tab 18' has a generally rounded exterior surface 50, providing yet a different and perhaps more simple assembly with less friction between respective module members 8'.

While this invention lends itself to use with precious metals and precious stones, the individual modules can be formed of non-precious metal and non-precious reflective or semi-precious or other stones can be employed along the outer edges of the assembled jewelry item.

FIG. 7 is a schematic perspective view of the jewelry item of this invention showing stones 76 mounted along gaps 78 of the plurality of modules 8 joined together to form the jewelry item and other stones 76' mounted along gaps 80 on the opposite side of modules 8. FIG. 7 illustrates that different colored stones may be employed, e.g., one being ruby red 76' and one being diamond white 76. The attractive appearance and unusual nature of this twisted jewelry item is readily apparent from FIG. 7. Modules used to assemble the jewelry item of FIG. 7 could be of either the embodiments of FIGS. 1 and 2 or FIGS. 5 and 6 (or other embodiments described below). The relative rotation between each module is uniform throughout the jewelry item of FIG. 7 presenting the uniform spiral appearance illustrated.

Figure 8:
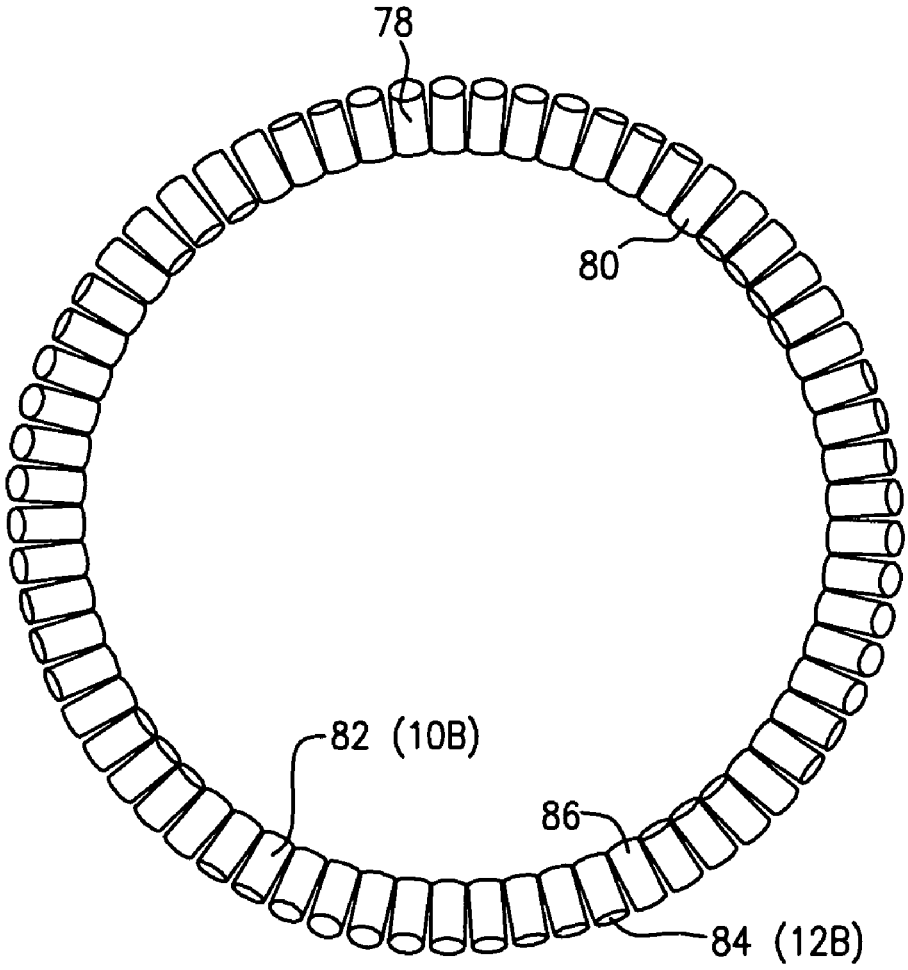
FIG. 8 is a top schematic perspective view of the jewelry item of this invention showing the mounting space for stones along the outer edges and mounting space on the top and bottom of the modules.

FIG. 8 is another schematic perspective view of a jewelry item partially assembled with modules 8 of the present invention, especially those of FIGS. 1 and 2 in which sufficient space is provided on the outer gaps 78 and 80 of each module permitting stones 86 to be mounted thereon. Modules 8 each have additional mounting areas 82 and 84 on the top and bottom of each module, corresponding to surfaces 10B and 12B of plates and 10 and 12. With this mounting scheme, additional stones can be mounted on any of the four sides of the module 8, or on all of them. Alternatively or in addition to stones 86, surfaces 10B and 12B could be facet cut with glossy areas to create brilliant flashes of light when light reflects therefrom. That is, surfaces 10B and/or 12B can be made to be the ornamental surfaces themselves without having a stone mounted thereon.

Figure 9:
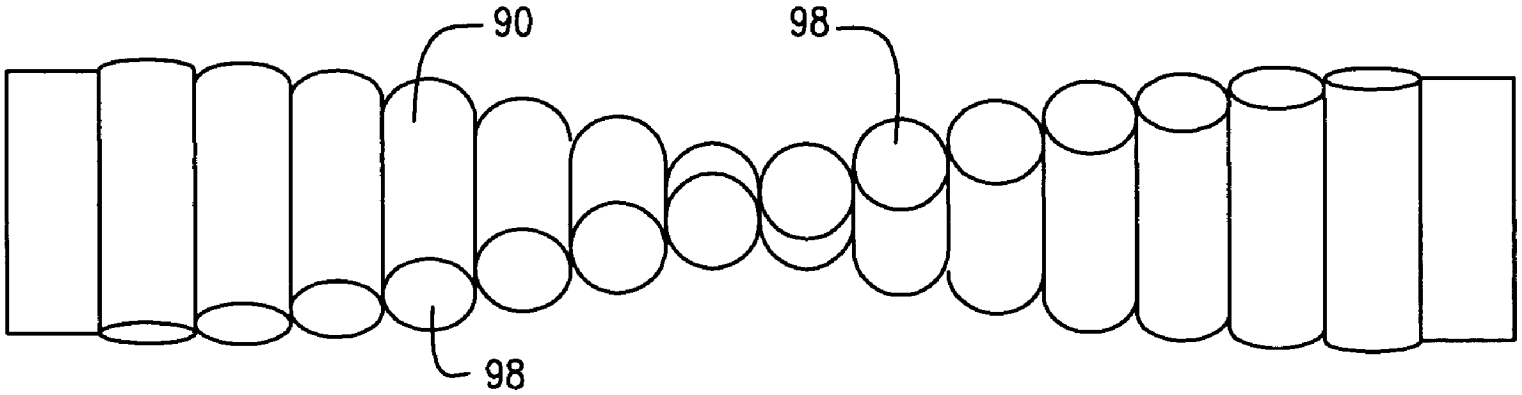
FIG. 9 is a side plan view of a section of an alternative cylindrical shape for the modules forming a twisted jewelry item.
Figure 10:
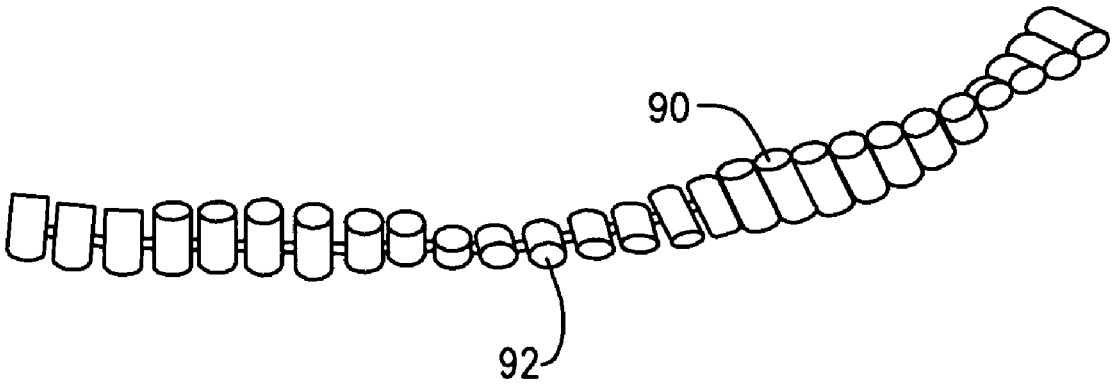
FIG. 10 is schematic view of a section of the twisted jewelry item of FIG. 9 with stones mounted on opposite edges thereof.

FIGS. 9 and 10 are schematics of a cylindrical main body 90 for the individual module. Male and female elements (not shown) of a similar structure as described above with reference to FIGS. 1–8 allows each of the cylindrical modules to be offset with respect to a prior cylindrical module so that a relatively uniform twist or rotation is achieved when the modules 90 are assembled together. FIG. 10 is an artist's rendition of a perspective view of the twisted bracelet of FIG. 9 in which stones 92 are mounted on the outer end faces 98 of each of the cylindrical modules to provide yet another embodiment for the twisted jewelry item of this invention. Optionally, stones could be mounted on the other end face opposite end face 98 in the same or different color, size, or shape as stones 92.

Figure 11:
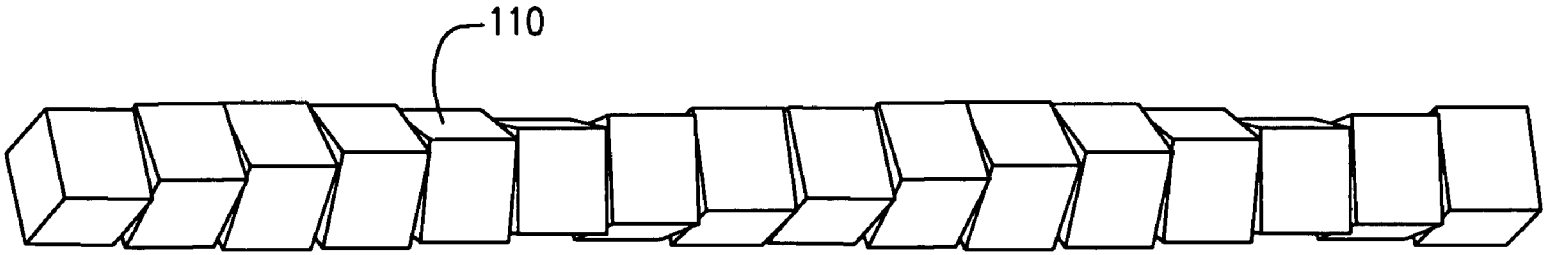
FIG. 11 is a perspective view of an alternative square shape for the modules of this invention.

FIG. 11 is yet another embodiment of this invention in which each of the modules 110 is square with the relative rotational effect illustrated therein. The different colors displayed shows the relative twist achieved as the square modules are assembled one into the other in accordance with the teachings of this invention. As with the prior embodiments, precious stones may be mounted along the outer side edge or on all four sides of the square module as desired by the designer.

As stated, the twisted jewelry item could be a necklace, tennis bracelet, choker, anklet, finger ring, or other such similar closed loop of jewelry depending upon the jeweler's design and the wearer's desire and comfort.

The inventive modules may be made entirely from precious metals or they may be coated (e.g., electroplated) with a layer of precious metal. Each surface of the inventive module may be coated with a different precious metal, if desired.

Although it is generally contemplated that stones or other ornamental features would be incorporated at both side ends of each module, embodiments in which a stone is carried at only one end of each module, or just on the front and/or back faces of each module, or on one or both transverse ends and on one or both of the front and back faces of each (or every other, or third, etc) module, as a general matter of design choice, are also intended to be within the inventive scope. Similarly, each module may carry only a single end- or face-mounted stone, with each alternate module having the stone on the other side of the resulting bracelet. In essence, of the two or four potential ornamental surfaces in any module, any of the various combinations of sides, ends, stones, facets, and the like are contemplated as part of the invention.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

What is claimed is:

1. A jewelry bracelet or necklace comprising:

a plurality of individual modules which form said necklace or bracelet, said necklace or bracelet having a longitudinal direction, said individual modules having nominal top, bottom and outer sides; and jewelry stones mounted at said outer sides of said individual modules, said individual modules being logitudinally radially offset with respect to adjacent modules and being substantially fixed in relationship to each other such that said outer sides having said jewelry stones twist around said longitudinal direction and form a spiral pattern along said necklace or bracelet even when ends of the jewelry article are not connected.

2. A jewelry item in accordance with claim 1, wherein the radial offset between adjacent modules is substantially equal in said jewelry bracelet or necklace to provide said spiral appearance.

3. A jewelry bracelet or necklace in accordance with claim 1, wherein said jewelry stones comprises diamonds.

4. A jewelry bracelet or necklace in accordance with claim 1, wherein said jewelry stones comprises rubies.

5. A jewelry bracelet or necklace in accordance with claim 1, wherein said jewelry stones comprises a combination of different precious stones.

6. A jewelry bracelet or necklace in accordance with claim 1, wherein said jewelry stones comprise at least one type of non-precious stone.

7. A jewelry bracelet or necklace in accordance with claim 2, wherein said modules are formed of precious metal.

8. A jewelry bracelet or necklace in accordance with claim 7, wherein said precious metal is gold.

9. A jewelry bracelet or necklace in accordance with claim 7, wherein said precious metal is silver.

10. A jewelry bracelet or necklace in accordance with claim 7, wherein said precious metal is platinum.

11. A jewelry bracelet or necklace in accordance with claim 1, further comprising structure to mount jewelry stones on said top side of said loop which top side twists longitudinally along said jewelry bracelet or necklace.

12. A jewelry bracelet or necklace in accordance with claim 2, further comprising structure to mount a jewelry stone on a bottom side of each of said modules.

13. A twisted jewelry article, comprising:

a plurality of modules, each module including:

a main body having a longitudinal axis;

a female receptacle disposed inside said main body and accessible via a rear portion of said main body, said female receptacle having a first inner surface;

a male tab projecting from a front portion of said main body, said male tab having a second outer surface, said male tab being fittable within an adjacent of said female receptacle of an adjacent of said modules with said second outer surface being substantially contactable with said first inner surface of said adjacent female receptacle, wherein, in at least a certain subset of said modules, said second outer surface is angularly offset to said first inner surface about said longitudinal axis to thereby angularly offset adjacent of said modules having said offset, to thereby impart a longitudinal twist to said jewelry article even when ends of the jewelry article are not connected.

14. A twisted jewelry article according to claim 13, further comprising at least one ornamental surface disposed on at least a portion of said modules in the same corresponding position, wherein said longitudinal twist makes said ornamental surfaces of said modules take the form of a spiral about said longitudinal axis.

15. A twisted jewelry article in accordance with claim 13, wherein said subset includes all of said modules and each of said modules are angularly offset about said longitudinal axis with respect to an adjacent of said modules.

16. A twisted jewelry article in accordance with claim 13, wherein said offset between adjacent of said modules is uniform along the length of the jewelry item.

17. A twisted jewelry article in accordance with claim 15, wherein said offset between adjacent of said modules is uniform along the length of the jewelry item.

18. A twisted jewelry article according to claim 14, wherein said ornamental surface comprises a mounting space along a side of said main body upon which jewelry stones are mountable.

19. A twisted jewelry article in accordance with claim 13, further comprising a jewelry stone mounted on a first side of at least a portion of said plurality of modules.

20. A twisted jewelry article in accordance with claim 18, further comprising a jewelry stone mounted in said mounting space of at least a portion of said plurality of modules.

21. A twisted jewelry article in accordance with claim 14, wherein said ornamental surface comprises at least one precious jewelry stone per said module having said ornamental surface.

22. A twisted jewelry article in accordance with claim 13, wherein said jewelry article is a closed loop to form jewelry such as a necklace or bracelet.

23. A twisted jewelry article in accordance with claim 21, wherein said precious stones comprise at least one of diamonds, rubies, sapphires, or emeralds.

24. A twisted jewelry article in accordance with claim 21, wherein said precious stones comprises a combination of different precious stones.

25. A twisted jewelry article in accordance with claim 19, wherein said jewelry stone comprises a non-precious stone.

26. A twisted jewelry article in accordance with claim 13, wherein at least selected ones of said plurality of modules comprise precious metal.

27. A twisted jewelry article in accordance with claim 14, wherein each of said plurality of modules comprises precious metal.

28. A twisted jewelry article in accordance with claim 27, wherein said precious metal is at least one of gold, silver, or platinum.

29. A twisted jewelry article in accordance with claim 27, wherein said precious metal is the same for all of said select modules.

30. A twisted jewelry article in accordance with claim 27, wherein said precious metal is different for said select modules.

31. A twisted jewelry article in accordance with claim 14, wherein said at least one ornamental surface comprise means to mount a jewelry stone on at least one of a top surface or a bottom surface of each of said modules.

32. A twisted jewelry article in accordance with claim 14, further comprising a second ornamental surface disposed on a side of said module opposite said first ornamental surface.

33. A twisted jewelry article in accordance with claim 13, wherein said angular offset between said first and second surfaces is between 9 and 18 degrees.

34. A twisted jewelry article in accordance with claim 13, wherein said main body is rectangular in shape.

35. A twisted jewelry article in accordance with claim 13, wherein said main body is cylindrical in shape.

36. A twisted jewelry article in accordance with claim 13, wherein said main body is square in shape.

37. A twisted jewelry article in accordance with claim 13, wherein said main body comprises two substantially parallel plates attached to opposite sides of said female receptacle, said plates having spaces therebetween at opposite ends.

38. A twisted jewelry article in accordance with claim 37, further comprising first jewelry stones mounted in a first of said spaces in at least a number of said modules.

39. A twisted jewelry article in accordance with claim 38, wherein said first jewelry stones are mounted in said first spaces in all of said modules.

40. A twisted jewelry article in accordance with claim 38, further comprising second jewelry stones, different from said first jewelry stones, mounted in a second of said spaces opposite said first space in at least said number of said modules.

41. A twisted jewelry article in accordance with claim 40, wherein said second jewelry stones are mounted in said second space in all of said modules.

42. A twisted jewelry article in accordance with claim 13, wherein a width of said tab is substantially identical to a width of said receptacle, to thereby substantially eliminate angular play between adjacent of said modules.

43. A twisted jewelry article in accordance with claim 13, wherein a width of said tab is slightly smaller than a width of said receptacle, to thereby substantially allow angular play between adjacent of said modules and thus allow the wearer to adjust but not eliminate said longitudinal twist imparted to said jewelry article.

44. A twisted jewelry article in accordance with claim 43, wherein said angular play allowed between adjacent of said modules is less than said angular offset.

45. A twisted jewelry article, comprising:

a plurality of modules, each module including:

a main body having a longitudinal axis and at least one ornamental surface;

a female receptacle disposed inside said main body and accessible via a rear portion of said main body, said female receptacle having a first inner surface;

a male tab projecting from a front portion of said main body, said male tab having a second outer surface, said male tab being fittable within an adjacent of said female receptacle of an adjacent of said modules with said second outer surface being substantially contactable with said first inner surface of said adjacent female receptacle, wherein said second outer surface is angularly offset to said first inner surface about said longitudinal axis to thereby angularly offset adjacent of said modules having said offset, to thereby impart a longitudinal twist to said jewelry article, even when ends of the jewelry article are not connected and wherein said longitudinal twist makes said ornamental surfaces of said modules take the form of a spiral about said longitudinal axis.

46. A twisted jewelry article in accordance with claim 45, wherein said offset between adjacent of said modules is uniform along the length of the jewelry item.

47. A twisted jewelry article according to claim 45, wherein said ornamental surface comprises a mounting space along a side of said main body upon which jewelry stones are mountable.

48. A twisted jewelry article in accordance with claim 47, further comprising a jewelry stone mounted on a first side of each of said plurality of modules.

49. A twisted jewelry article in accordance with claim 46, further comprising a jewelry stone mounted in said mounting space of each of said plurality of modules.

50. A twisted jewelry article in accordance with claim 45, wherein said jewelry article is a closed loop to form jewelry such as a necklace or bracelet.

51. A twisted jewelry article in accordance with claim 48, wherein said jewelry stones comprise at least one of diamonds, rubies, sapphires, emeralds, or non-precious stones.

52. A twisted jewelry article in accordance with claim 48, wherein said precious stones comprises a combination of different precious stones.

53. A twisted jewelry article in accordance with claim 45, wherein said at least one ornamental surface comprise means to mount a jewelry stone on at least one of a top surface and a bottom surface of each of said modules.

54. A twisted jewelry article in accordance with claim 45, further comprising a second ornamental surface disposed on a side of said module opposite said first ornamental surface.

55. A twisted jewelry article in accordance with claim 54, further comprising a third ornamental surface on one of a top surface and a bottom surface of each of said modules.

56. A twisted jewelry article in accordance with claim 55, further comprising a fourth ornamental surface on the other of said top surface and said bottom surface of each of said modules opposite said third ornamental surface.

57. A twisted jewelry article in accordance with claim 45, wherein said angular offset between said first and second surfaces is between 9 and 18 degrees.

58. A twisted jewelry article in accordance with claim 45, wherein said main body is one of rectangular, cylindrical, square, or polyhedral in shape.

59. A twisted jewelry article in accordance with claim 45, wherein said main body comprises two substantially parallel plates attached to opposite sides of said female receptacle, said plates having spaces therebetween at opposite ends.

60. A twisted jewelry article in accordance with claim 59, further comprising first jewelry stones mounted in a first of said spaces in each of said modules.

61. A twisted jewelry article in accordance with claim 60, further comprising second jewelry stones, different from said first jewelry stones, mounted in a second of said spaces opposite said first space in each of said modules.

62. A twisted jewelry article in accordance with claim 45, wherein a width of said tab is substantially identical to a width of said receptacle, to thereby substantially eliminate angular play between adjacent of said modules.

63. A twisted jewelry article in accordance with claim 45, wherein a width of said tab is slightly smaller than a width of said receptacle, to thereby substantially allow angular play between adjacent of said modules and thus allow the wearer to adjust but not eliminate said longitudinal twist imparted to said jewelry article.

64. A twisted jewelry article in accordance with claim 63, wherein said angular play allowed between adjacent of said modules is less than said angular offset.

* * * * *